US006783445B2

(12) United States Patent
Torii et al.

(10) Patent No.: US 6,783,445 B2
(45) Date of Patent: Aug. 31, 2004

(54) POLISHING APPARATUS

(75) Inventors: Hiroomi Torii, Tokyo (JP); Hideo Aizawa, Tokyo (JP); Soichi Isobe, Tokyo (JP)

(73) Assignee: Ebara Corporation, Tokyo (JP)

( * ) Notice: Subject to any disclaimer, the term of this patent is extended or adjusted under 35 U.S.C. 154(b) by 95 days.

(21) Appl. No.: 09/962,330

(22) Filed: Sep. 26, 2001

(65) Prior Publication Data

US 2002/0039880 A1 Apr. 4, 2002

(30) Foreign Application Priority Data

Sep. 27, 2000 (JP) ..... 2000-294666

(51) Int. Cl.[7] ..... B24B 53/00
(52) U.S. Cl. ..... 451/287; 451/443; 451/444
(58) Field of Search ..... 451/56, 444, 285–289

(56) References Cited

U.S. PATENT DOCUMENTS 5,154,021 A * 10/1992 Bombardier et al. ..... 451/444
5,421,768 A * 6/1995 Fujiwara et al. ..... 451/283
5,846,336 A * 12/1998 Skrovan ..... 134/10
5,931,725 A * 8/1999 Inaba et al. ..... 451/288
6,030,487 A * 2/2000 Fisher et al. ..... 156/345.14
6,099,393 A * 8/2000 Katagiri et al. ..... 451/56
6,179,693 B1 * 1/2001 Beardsley et al. ..... 451/56
6,200,207 B1 * 3/2001 Hsu ..... 451/443
6,217,430 B1 * 4/2001 Koga et al. ..... 451/444
6,224,472 B1 * 5/2001 Lai et al. ..... 451/398
6,302,771 B1 * 10/2001 Liu et al. ..... 451/56
6,347,979 B1 * 2/2002 Drill ..... 451/41
6,350,183 B2 * 2/2002 Manfredi ..... 451/56
6,358,124 B1 * 3/2002 Koga et al. ..... 451/56
6,443,816 B2 * 9/2002 Inoue et al. ..... 451/56
6,454,637 B1 * 9/2002 Gotkis ..... 451/287
6,508,697 B1 * 1/2003 Benner et al. ..... 451/443
6,527,624 B1 * 3/2003 Tolles et al. ..... 451/41

FOREIGN PATENT DOCUMENTS

WO 99/11433 3/1999

OTHER PUBLICATIONS

Tatsuo Inoue et al., U.S. patent application Ser. No. 09/790, 976, filed Feb. 23, 2001.

* cited by examiner

*Primary Examiner*—M. Rachuba
(74) *Attorney, Agent, or Firm*—Wenderoth, Lind & Ponack, L.L.P.

(57) ABSTRACT

A polishing apparatus comprises a polishing table having a polishing surface thereon, a top ring for pressing a workpiece to be polished against the polishing surface, and a dresser for dressing the polishing surface on the polishing table. The dresser comprises a dressing element provided on a surface of the dresser for dressing the polishing surface by sliding contact with the polishing surface, and an ejection nozzle provided on the surface of the dresser for ejecting a fluid supplied from a fluid source toward the polishing surface.

16 Claims, 8 Drawing Sheets

POLISHING APPARATUS

BACKGROUND OF THE INVENTION

1. Field of the Invention

The present invention relates to a polishing apparatus for polishing a workpiece to be polished, and more particularly to a polishing apparatus for polishing a workpiece having a thin film formed thereon, such as a semiconductor wafer, to a flat mirror finish.

2. Description of the Related Art

As semiconductor devices have become more highly integrated in recent years, circuit interconnections have become finer and distances between these circuit interconnections become smaller. In case of photolithography which can form interconnections that are at most 0.5 $\mu$m wide, it is required that surfaces on which pattern images are to be focused by a stepper should be as flat as possible because a depth of focus of an optical system is relatively small. A polishing apparatus for performing chemical mechanical polishing (CMP) has been used for planarizing semiconductor wafer.

This type of polishing apparatus comprises, as shown in FIG. 1, a polishing table 302 having a polishing cloth (polishing pad) 300 attached thereon and constituting a polishing surface, and a top ring 304 for holding a substrate W as a workpiece to be polished, such as a semiconductor wafer, in such a manner that a surface to be polished faces the polishing cloth 300. A semiconductor wafer W is polished by this polishing apparatus as follows: The polishing table 302 and the top ring 304 are independently rotated, and, while a polishing liquid is supplied from a polishing liquid nozzle 306 provided above the polishing table 302, the semiconductor wafer W is pressed against the polishing cloth 300 on the polishing table 302 at a predetermined pressure by the top ring 304. For example, a suspension of fine polishing particles of silica or the like in an alkali solution is used as the polishing liquid supplied from the polishing liquid nozzle 306. Thus, the semiconductor wafer W is polished to a flat mirror finish by a combined effect of a chemical polishing effect attained by the alkali and a mechanical polishing effect attained by the polishing particles.

When the semiconductor wafer W is brought into contact with the polishing cloth 300, and the polishing table 302 is rotated to perform polishing, a polishing liquid or ground-off particles of semiconductor material are attached to the polishing cloth 300, resulting in a change in properties of the polishing cloth 300 and deterioration in polishing performance. Therefore, if an identical polishing cloth 300 is repeatedly used for polishing semiconductor wafers W, problems such as lowered polishing rate and uneven polishing are caused. In order to overcome such problems, a dresser 308 is provided in the polishing apparatus, and the polishing cloth 300 is dressed by the dresser 308 at a time of replacement of a semiconductor wafer W to be polished, for example. During a dressing process, while a dressing element attached to a lower surface of the dresser 308 is pressed against the polishing cloth 300 on the polishing table 302, the polishing table 302 and the dresser 308 are independently rotated to remove the polishing liquid and the ground-off particles of the semiconductor material which are attached to the polishing surface and to flatten and dress the polishing surface in its entirety, whereby the polishing surface is regenerated. This dressing process is also referred to as a conditioning process.

During the dressing process, a portion of the dressing element brought into sliding contact with the polishing surface may come off the lower surface of the dresser and remain on the polishing surface in some cases. If the portion of the dressing element that has come off the lower surface of the dresser remains on the polishing surface, then a surface of a subsequent semiconductor wafer to be polished may be scratched by this portion of the dressing element.

For example, in the case of a diamond dresser, which comprises a dressing element constituted by particles such as diamond particles electrodeposited on a lower surface of a dresser, in order to reduce a number of diamond particles which come off the dressing element, it has been attempted to reduce a number of suspended particles present on the lower surface of the dressing element by performing an initial run-in or positioning the diamond particles at increased intervals. However, it is highly difficult to completely eliminate diamond particles from coming off the dressing element.

After a semiconductor wafer is polished by the top ring, polishing liquid used during the polishing process and ground-off particles of semiconductor material may possibly remain on the polishing surface of the polishing cloth. Since these remaining polishing liquid and ground-off particles tend to scratch a surface of a semiconductor wafer, it is necessary to remove them before a subsequent polishing process is performed.

SUMMARY OF THE INVENTION

It is therefore an object of the present invention to provide a polishing apparatus which can reliably remove a portion of a dressing element that has come off the dressing element, a polishing liquid, and ground-off particles of a workpiece material, with ease, and can increase quality of polishing of a workpiece.

In order to attain the above object, according to a first aspect of the present invention, there is provided a polishing apparatus comprising: a polishing table having a polishing surface thereon; a top ring for pressing a workpiece to be polished against the polishing surface; a dresser for dressing the polishing surface on the polishing table; a dressing element provided on a surface of the dresser for dressing the polishing surface by sliding contact with the polishing surface; and an ejection nozzle provided on the surface of the dresser for ejecting a fluid supplied from a fluid source toward the polishing surface.

With the above arrangement, a portion of the dressing element that has come off the dressing element during a dressing process, a polishing liquid, and ground-off particles of a workpiece material, are scattered toward an exterior of the dresser by fluid ejected from the ejection nozzle. Thus, the portion of the dressing element, the polishing liquid, and the ground-off particles, which remain on the polishing surface to cause a scratch, can effectively be removed from the polishing surface. Therefore, quality of polishing of a workpiece can be increased.

According to a second aspect of the present invention, there is provided a polishing apparatus comprising: a polishing table having a polishing surface thereon; a top ring for pressing a workpiece to be polished against the polishing surface; a dresser for dressing the polishing surface on the polishing table; a dressing element provided on a surface of the dresser for dressing the polishing surface by sliding contact with the polishing surface; and an ejection nozzle provided on the surface of the dresser for ejecting a mixture of a liquid supplied from a liquid source and a gas supplied from a gas source toward the polishing surface.

With the above arrangement, a polishing liquid and ground-off particles of a workpiece material which have fallen into recesses in the polishing surface can be blown away from the recesses by the gas contained in the mixture, and, further, can be washed away by the liquid. Thus, the polishing surface can effectively be cleaned.

Preferably, a dressing element is annularly disposed on the lower surface of the dresser, and the ejection nozzle is disposed inside of the annularly disposed dressing element.

According to a preferred aspect of the present invention, the dressing element has a fluid flow hole defined therethrough for flowing fluid from the fluid source to a lower surface of the dressing element, and a fluid ejection slot defined in a lower surface of the dressing element; and the fluid ejection slot is extended from the fluid flow hole to an outer circumferential edge of the dressing element.

With the above arrangement, fluid strongly flows out of the dresser under centrifugal forces due to rotation of the dresser. Therefore, a polishing surface can effectively be cleaned.

Preferably, the fluid ejection slot is extended toward an outer circumferential edge of the dresser. This arrangement can effectively increase a force of flow of fluid. Hence, an effect of cleaning of a polishing surface can be improved.

The above and other objects, features, and advantages of the present invention will be apparent from the following description when taken in conjunction with the accompanying drawings which illustrates preferred embodiments of the present invention by way of example.

DETAILED DESCRIPTION OF THE PREFERRED EMBODIMENTS

A polishing apparatus according to an embodiment of the present invention will be described below with reference to FIGS. 2 through 7B.

Figure 1:
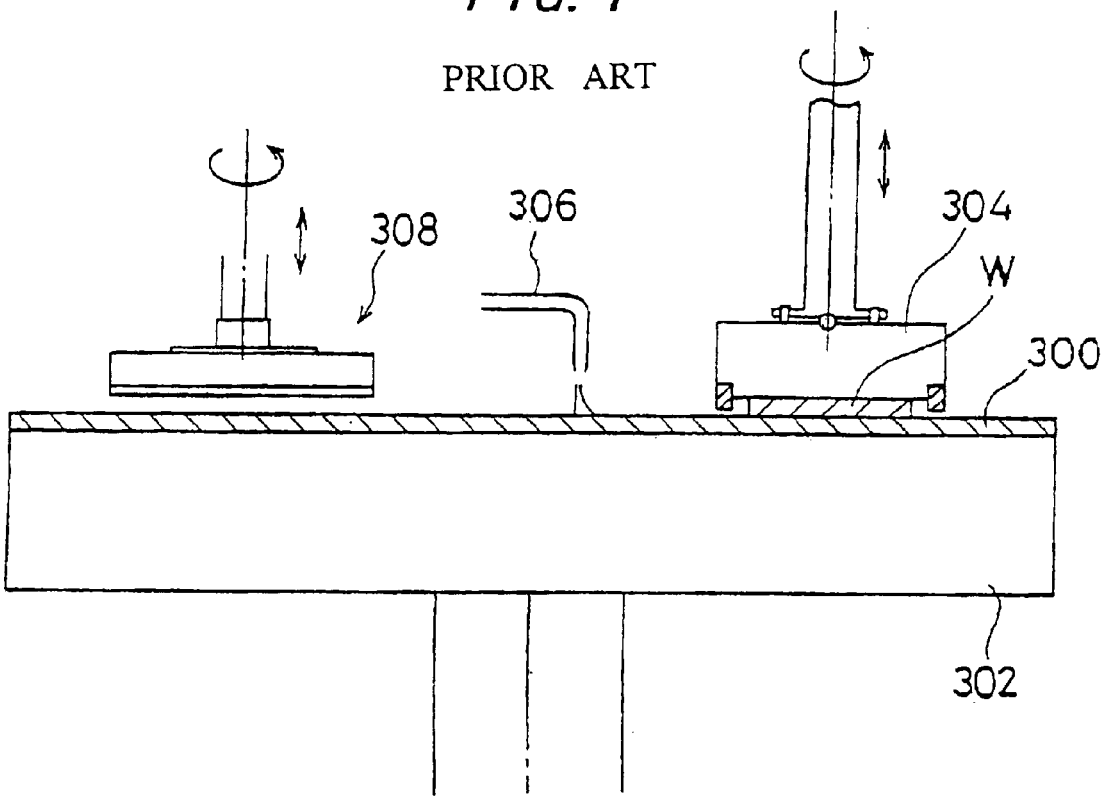
FIG. 1 PRIOR ART
FIG. 1 is a vertical cross-sectional view showing a conventional polishing apparatus.
Figure 2:
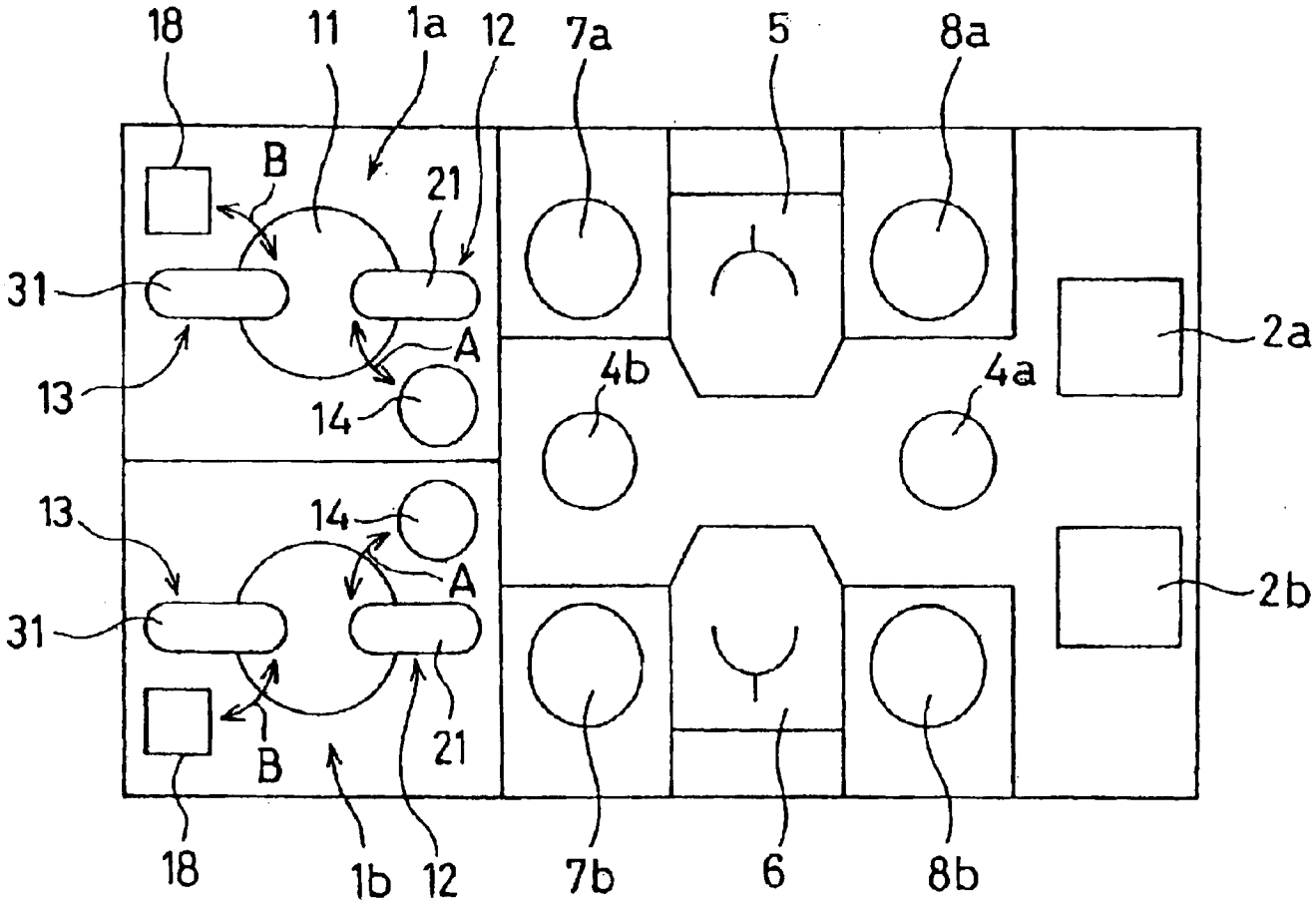
FIG. 2 is a plan view showing a polishing apparatus according to an embodiment of the present invention.
Figure 3:
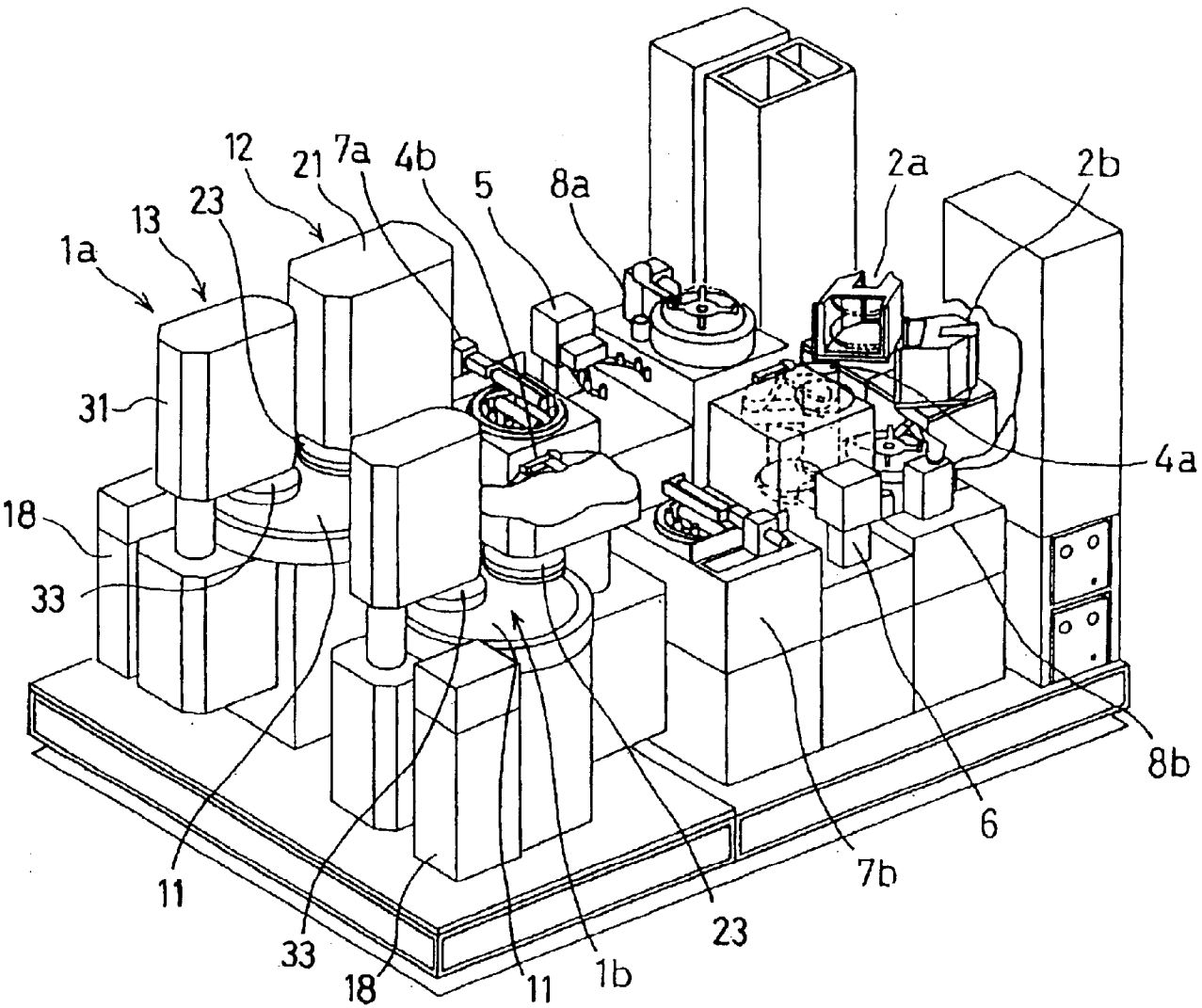
FIG. 3 is a perspective view showing the polishing apparatus shown in FIG. 2.

FIG. 2 is a plan view showing a polishing apparatus according to an embodiment of the present invention, and FIG. 3 is a perspective view showing the polishing apparatus shown in FIG. 2. As shown in FIGS. 2 and 3, in the polishing apparatus according to this embodiment, a pair of polishing sections 1*a*, 1*b* is disposed on one side of a space on a floor having a rectangular shape, so as to laterally face each other. A pair of load/unload units for placing thereon cassettes 2*a*, 2*b* for accommodating semiconductor wafers therein is disposed on another side of the space. Two transfer robots 4*a*, 4*b* for transferring a semiconductor wafer are disposed on a line connecting the polishing sections 1*a*, 1*b* to the load/unload units to constitute a transfer line. Two inverters 5, 6 are disposed on each side of the transfer line, and two sets of cleaning units 7*a*, 7*b* and 8*a*, 8*b* are disposed on each side of the transfer line. The inverter 5 is interposed between the cleaning units 7*a* and 8*a*, and the inverter 6 is interposed between the cleaning units 7*b* and 8*b*.

The two polishing sections 1*a*, 1*b* have basically identical specifications relative to each other, and are positioned symmetrically with respect to the transfer line. Each of the polishing sections 1*a*, 1*b* comprises a polishing table 11 having a polishing cloth attached to an upper surface thereof, a top ring unit 12 for holding a semiconductor wafer W, as a workpiece to be polished, by vacuum suction and pressing the semiconductor wafer W against the polishing table 11 to polish the semiconductor wafer W, and a dressing unit 13 for dressing the polishing cloth on the polishing table 11. Pushers 14 for receiving a semiconductor wafer W from the top ring unit 12 and transferring the semiconductor wafer W to the top ring unit 12 are provided near the transfer line in each of the polishing sections 1*a*, 1*b*.

A polishing surface is constituted by an upper surface of the polishing cloth. The polishing surface may be constituted by a fixed abrasive pad or a grinding stone. The polishing cloth can be made of elastic polyurethane foam or a non-woven fabric. The grinding stone comprises abrasive particles fixed by a binder of resin or the like. One example of fixed abrasive pads comprises an upper layer of abrasive particles fixed by a binder and a lower layer of an elastic pad attached to the upper layer. Alternatively, the fixed abrasive pad comprises abrasive particles fixed by an elastic binder such as polyurethane.

Each of the transfer robots 4*a*, 4*b* has an articulated arm which is bendable and extendable within a horizontal plane, and upper and lower holding portions which are separately used as a dry finger and a wet finger, respectively. Since two robots are used in this embodiment, a first robot 4*a* is basically responsible for a region from the inverters 5, 6 to the cassettes 2*a*, 2*b*, and a second robot 4*b* is basically responsible for a region from the inverters 5, 6 to the polishing sections 1*a*, 1*b*.

The inverters 5, 6 serve to turn over a semiconductor wafer W, and are disposed at positions that can be reached by the hands of the transfer robots 4*a*, 4*b*. In this embodiment, the two inverters 5, 6 are separately utilized as a device for handling a dry semiconductor wafer and a device for handling a wet semiconductor wafer, respectively.

Each of the cleaning units 7*a*, 7*b*, 8*a* and 8*b* may be of any type. For example, the cleaning units 7*a*, 7*b* near the polishing sections 1*a*, 1*b* are of a type that wipes both sides of a semiconductor wafer with a roller equipped with a sponge, and the cleaning units 8*a*, 8*b* near the cassettes 2*a*, 2*b* are of a type that holds an edge of a semiconductor wafer and rotates the semiconductor wafer within a horizontal plane while supplying a cleaning liquid to the semiconductor wafer. The cleaning units 8*a*, 8*b* also serve as a drier for centrifugally drying a semiconductor wafer. The cleaning units 7*a*, 7*b* can perform a primary cleaning process of a semiconductor wafer, and the cleaning units 8*a*, 8*b* can perform a secondary cleaning process of a semiconductor wafer after the primary cleaning process.

Figure 4:
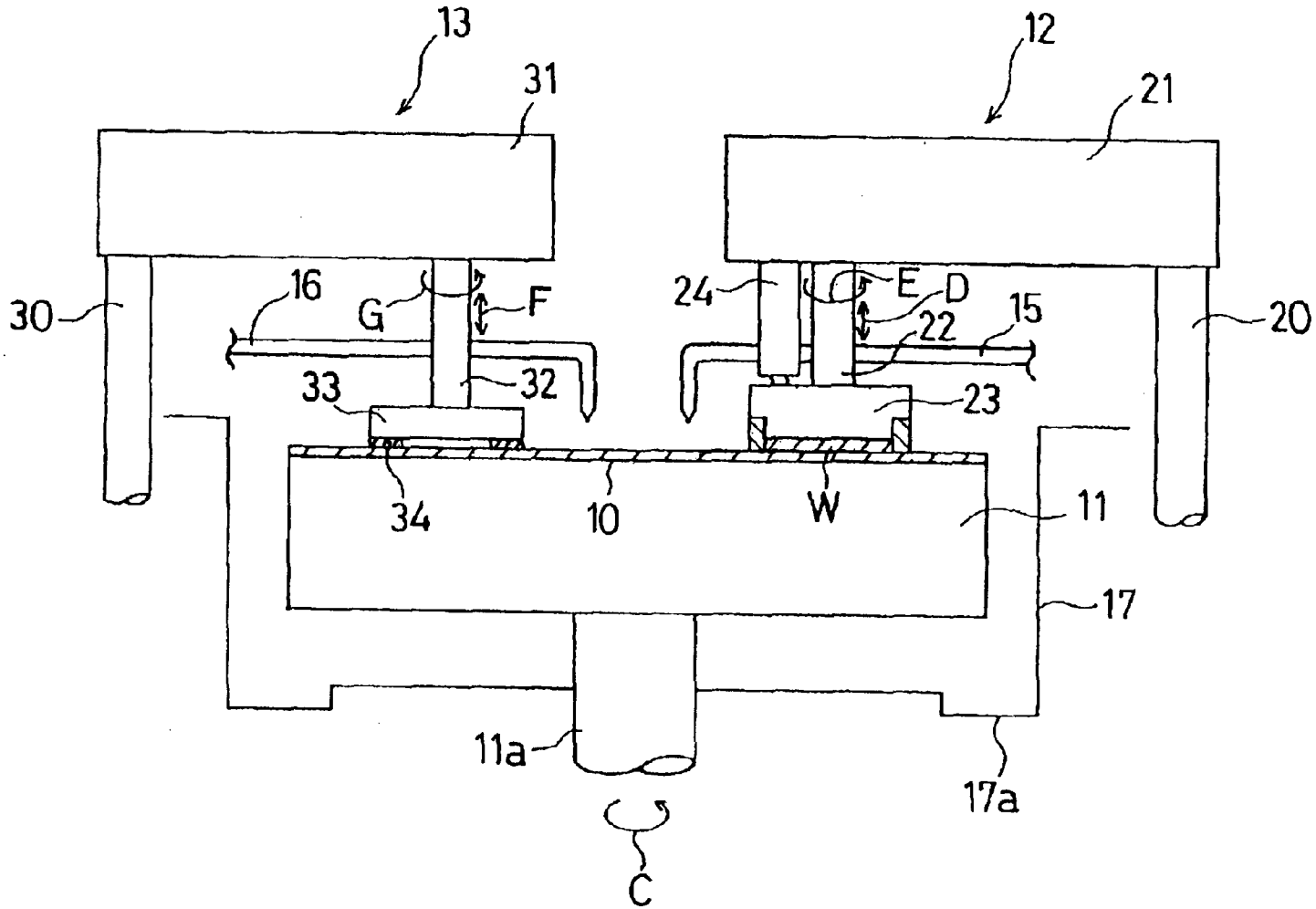
FIG. 4 is a vertical cross-sectional view showing a polishing section of the polishing apparatus shown in FIGS. 2 and 3.

FIG. 4 is a vertical cross-sectional view showing a main part of the polishing section la shown in FIGS. 2 and 3. Only the polishing section 1*a* will be described below. However, the following description can be applied to the polishing section 1*b*.

As shown in FIG. 4, polishing cloth 10 on the polishing table 11 has its upper surface serving as a polishing surface held in sliding contact with a semiconductor wafer W as a workpiece to be polished. The polishing table 11 is coupled to a motor (not shown) disposed below the polishing table 11 via a table shaft 11*a*, so that the polishing table 11 is rotatable about the table shaft 11*a* in a direction indicated by arrow C in FIG. 4.

A polishing liquid supply nozzle 15 and a water supply nozzle 16 are disposed above the polishing table 11. A polishing liquid for use during polishing is supplied onto the polishing cloth 10 from the polishing liquid supply nozzle 15. A dressing liquid for use during dressing, e.g., water, is supplied onto the polishing cloth 10 from the water supply nozzle 16. The polishing table 11 is surrounded by a frame 17 for recovering polishing liquid and water that have been supplied onto the polishing cloth 10. A tub 17*a* for collecting and draining the polishing liquid and the water is provided at a bottom of the frame 17.

The top ring unit 12 comprises a rotatable spindle 20, a swing arm 21 coupled to an upper end of the spindle 20, a top ring shaft 22 extended downwardly from a free end of the swing arm 21, and a substantially disk-shaped top ring 23 coupled to a lower end of the top ring shaft 22. When the swing arm 21 is swung by rotation of the spindle 20, the top ring 23 is horizontally moved, and thus can be reciprocated between the pusher 14 and a polishing position on the polishing cloth 10, as indicated by arrow A in FIG. 2. Further, the top ring 23 is coupled via the top ring shaft 22 to a motor (rotating mechanism) and a lifting/lowering cylinder (both not shown) provided within the swing arm 21, so that the top ring 23 is vertically movable, as indicated by arrow D in FIG. 4, and is rotatable about an axis of the top ring shaft 22, as indicated by arrow E in FIG. 4. A semiconductor wafer W as a workpiece to be polished is attracted to and held on a lower surface of the top ring 23 by vacuum suction or the like. Thus, the top ring 23 can rotate and press the semiconductor wafer W held on its lower surface against the polishing cloth 10 at a desired pressure.

The dressing unit 13 serves to regenerate a surface of the polishing cloth 10 that has been deteriorated as a result of a polishing operation, and is disposed at a position opposite to the top ring unit 12 with respect to a center of the polishing table 11. The dressing unit 13 comprises a rotatable spindle 30, a swing arm 31 coupled to an upper end of the spindle 30, a dresser shaft 32 extended downwardly from a free end of the swing arm 31, and a substantially disk-shaped dresser 33 coupled to a lower end of the dresser shaft 32, similar to the case of the top ring unit 12. When the swing arm 31 is swung by rotation of the spindle 30, the dresser 33 is horizontally moved, and thus can be reciprocated between a dressing position on the polishing cloth 10 and a standby position which is positioned outside of the polishing table 11, as indicated by arrow B in FIG. 2. Further, the dresser 33 is coupled via the dresser shaft 32 to a motor (rotating mechanism) and a lifting/lowering cylinder (both not shown) provided within the swing arm 31, so that the dresser 33 is vertically movable, as indicated by arrow F in FIG. 4, and is rotatable about the dresser shaft 32, as indicated by arrow G in FIG. 4.

Figure 5:
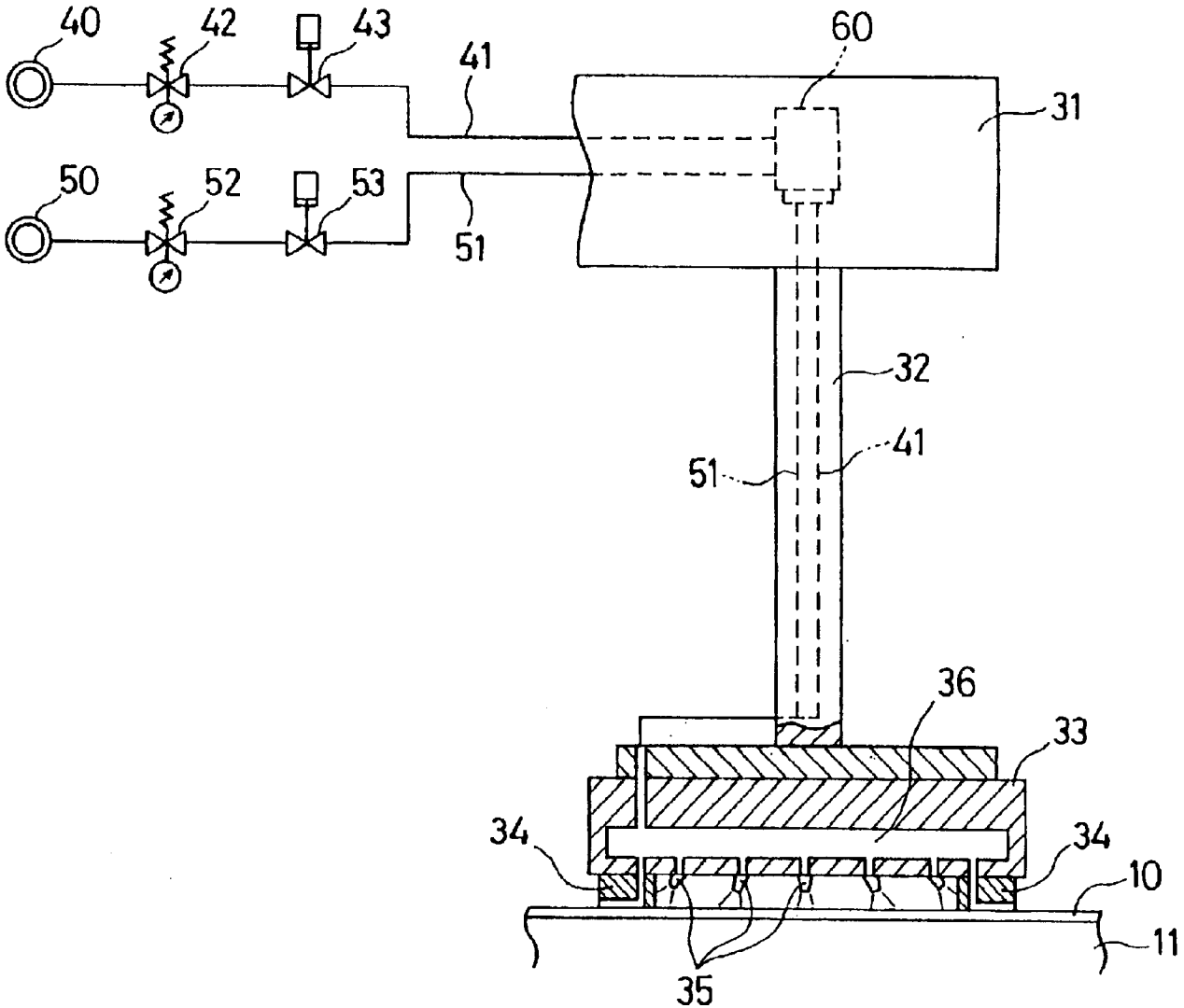
FIG. 5 is a schematic view showing a piping system of a dressing unit in the polishing section shown in FIG. 4.
Figure 6:
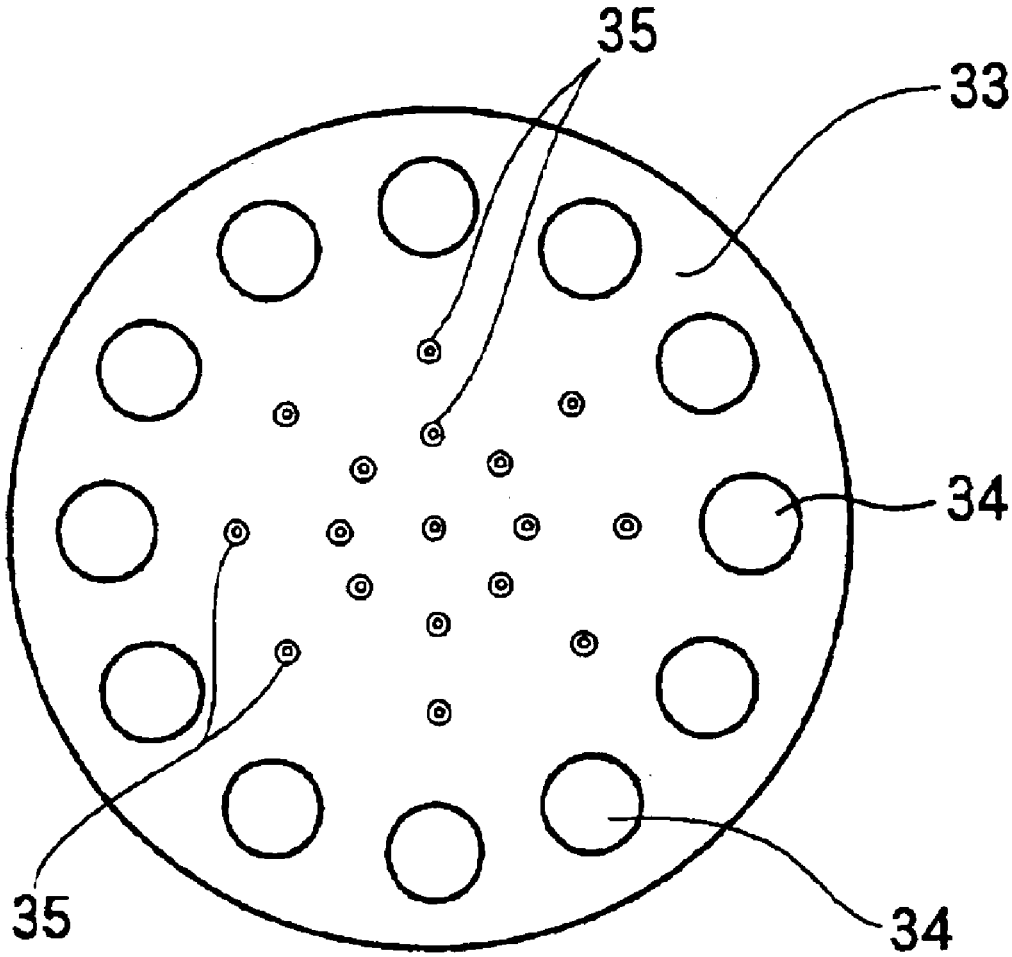
FIG. 6 is a bottom view showing a dresser in the dressing unit shown in FIG. 5.

FIG. 5 is a schematic view showing a piping system of the dressing unit 13 in the polishing section 1*a* shown in FIG. 4, and FIG. 6 is a bottom view showing the dresser 33 shown in FIG. 4. In FIG. 5, a portion of the dressing unit 13 is shown in cross section. As shown in FIGS. 5 and 6, the dresser 33 has a plurality of dressing elements 34 mounted on a lower surface of the dresser 33 for dressing the polishing cloth 10 by sliding contact with the polishing cloth 10. In this embodiment, each of the dressing elements 34 comprises a diamond pellet made of diamond particles electrodeposited on a disk, and a plurality of dressing elements 34 are mounted on the lower surface of the dresser 33. As shown in FIG. 6, the dressing elements 34 are positioned along a circumferential direction of the dresser 33 at predetermined intervals, and thus annularly disposed on the lower surface of the dresser 33 as a whole. The dresser 33 rotates and presses the dressing elements 34 against the polishing cloth 10 at a desired pressure to dress the polishing surface of the polishing cloth 10. The dressing elements 34 may comprise a brush which has elongated bristles such as nylon.

The dresser 33 has a plurality of ejection nozzles 35 provided on its lower surface for ejecting a liquid in the form of a mixture of a nitrogen gas and pure water as a cleaning liquid, toward a polishing surface of the polishing cloth 10. As shown in FIGS. 5 and 6, the ejection nozzles 35 are disposed in an area surrounded by the annularly disposed dressing elements 34, i.e., inside of the dressing elements 34. The ejection nozzles 35 are radially positioned around a center of the dresser 33. Each of the ejection nozzles 35 is a nozzle directed toward an outer circumferential edge of the dresser 33 so as to eject liquid toward the outer circumferential edge of the dresser 33.

As shown in FIG. 5, nitrogen gas from a nitrogen gas source (gas source) 40 and pure water from a pure water source (fluid source) 50 are supplied to the ejection nozzles 35 via a gas passage 41 and a liquid passage 51, respectively. Pressure of nitrogen gas from the nitrogen gas source 40 is regulated by a regulator 42. The nitrogen gas is supplied to the ejection nozzles 35 via an air-operated valve 43 and a rotary joint 60. Pressure of pure water from the pure water source 50 is regulated by a regulator 52. The pure water is supplied to the ejection nozzles 35 via an air-operated valve 53 and the rotary joint 60. The gas passage 41 and the liquid passage 51 are joined to each other to mix the pure water and the nitrogen gas at an upstream side of the ejection nozzles 35. A mixture of the pure water and the nitrogen gas flows into a passage 36 formed in the dresser 33 and is then supplied to the ejection nozzles 35 via the passage 36.

The mixture of the nitrogen gas and the pure water is brought in as liquid fine particles, solid fine particles as a result of solidification of liquid, or gas as a result of vaporization of liquid. To bring the mixture into these states is referred to as atomization. An atomized mixture is ejected from the ejection nozzles 35 toward the polishing table 11. Which state of the mixed liquid to be ejected, i.e., the liquid fine particles, the solid fine particles, or gas, is determined, for example, depending on pressure or temperature of the nitrogen gas and/or the pure water, or a shape of nozzles. Therefore, the state of the liquid to be ejected can be varied, for example, by properly varying pressure or temperature of the nitrogen gas and/or the pure water via a regulator or the like, or by properly varying a shape of nozzles.

Figure 7A:
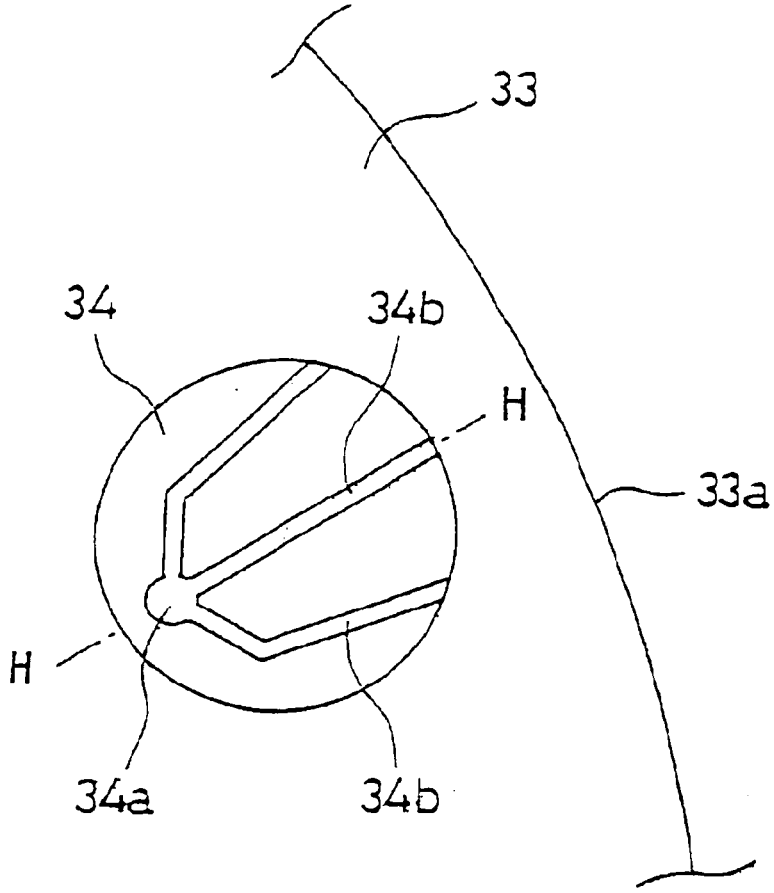
FIG. 7A is an enlarged view showing a dressing element of the dresser shown in FIG. 6.
Figure 7B:
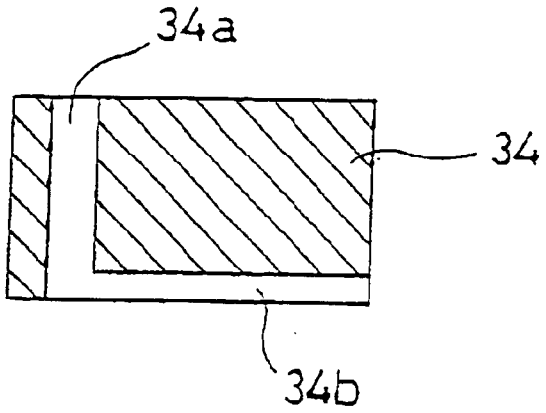
FIG. 7B is a cross-sectional view taken along a line H—H of FIG. 7A.

FIG. 7A is an enlarged view showing one of the dressing elements 34 shown in FIG. 6, and FIG. 7B is a cross-sectional view taken along a line of H—H in FIG. 7A. Each of the dressing elements 34 has a large number of diamond particles electrodeposited on a lower surface thereof. As shown in FIGS. 7A and 7B, the dressing element 34 has a vertical fluid flow hole 34*a* defined therethrough, and a plurality of fluid ejection slots 34*b* defined in the lower surface thereof. In this embodiment, as shown in FIG. 7A, the fluid ejection slots 34*b* are extended from a lower end of the fluid flow hole 34*a* toward an outer circumferential edge 33*a* of the dresser 33 and reach an outer circumferential edge of the dressing element 34. An upper end of the fluid flow hole 34*a* communicates with the passage 36 in the dresser 33. The mixture supplied from the passage 36 flows through the fluid flow hole 34*a* and the fluid ejection slots 34*b* and then flows out of the dresser 33.

Operation of the polishing apparatus thus constructed for polishing a semiconductor wafer W and dressing polishing cloth 10 will be described below.

When a polishing process of a semiconductor wafer W is performed in the polishing section 1*a*, the top ring 23 and the polishing table 11 are independently rotated, and a semiconductor wafer W held on the top ring 23 and the polishing table 11 are relatively moved to press the semiconductor wafer W held on a lower surface of the top ring 23 against the polishing cloth 10 on the polishing table 11. At this time, a polishing liquid is supplied from the polishing liquid supply nozzle 15 onto the upper surface of the polishing cloth 10. For example, a suspension of fine polishing particles of silica or the like in an alkali solution is used as the polishing liquid. Thus, the semiconductor wafer W is polished by a combined effect of a chemical polishing effect attained by the alkali and a mechanical polishing effect attained by the polishing particles. The polishing liquid used during the polishing process is scattered to an outside of the polishing table 11 by centrifugal force due to rotation of the polishing table 11, and is recovered in the tub 17*a* provided at the lower portion of the frame 17.

The polishing process of the semiconductor wafer W is completed when the semiconductor wafer W is polished to a certain thickness. At this time, properties of the polishing cloth 10 are changed due to the polishing process, so that polishing performance for a subsequent polishing process is deteriorated. Therefore, the polishing cloth 10 is dressed by the dressing unit 13. During a dressing process, the dresser 33 and the polishing table 11 are independently rotated, and the dressing elements 34 mounted on the dresser 33 are pressed against the polishing cloth 10 at a predetermined pressure. At the same time that the dressing elements 34 are brought into contact with the polishing cloth 10 or before the dressing elements 34 are brought into contact with the polishing cloth 10, water is supplied from the water supply nozzle 16 onto the polishing cloth 10 to wash away used polishing liquid that remains on the polishing cloth 10.

While the polishing cloth 10 is being dressed, the regulators 42, 52 and the air-operated valves 43, 53 are controlled to supply nitrogen gas and pure water at predetermined pressures and temperatures to the ejection nozzles 35 in the dresser 33 for ejecting a mixture of the nitrogen gas and the pure water to the polishing cloth 10. It is preferable to supply the nitrogen gas under pressures ranging from 0.01 MPa to 0.7 MPa, and to supply the pure water under pressures ranging from 0.1 MPa to 0.3 MPa. The mixture is ejected in an atomized state onto the polishing cloth 10, scattering a portion of the dressing elements 34 that has come off the dressing elements 34 in the dressing process toward the outside of the dresser 33. At the same time, this ejected mixture scatters polishing liquid and ground-off particles of the semiconductor material remaining on the polishing cloth 10 toward an exterior of dresser 33. Particularly, polishing liquid and ground-off particles that have fallen into recesses in the polishing cloth 10 can be blown away from the recesses by gas contained in the mixture, and, further, can be washed away by cleaning liquid (pure water). Thus, the polishing liquid and the ground-off particles, which remain on the polishing cloth 10 to cause a scratch, can effectively be removed from the polishing cloth 10.

The mixture simultaneously flows from the passage 36 in the dresser 33 through the fluid flow hole 34*a* and the fluid ejection slots 34*b*, out of the dresser 33. Since the dresser 33 is rotated at this time, the mixture is forced to flow out of the dresser 33 under centrifugal forces. Therefore, the polishing cloth 10 is effectively cleaned. Particularly, since the fluid ejection slots 34*b* are extended from the fluid flow hole 34*a* toward the outer circumferential edge 33*a* of the dresser 33, as shown in FIG. 7A, the mixture strongly flows out of the dresser 33. Hence, an effect of cleaning of the polishing cloth 10 can be improved.

Water supplied onto the polishing cloth 10 and the mixture ejected from the ejection nozzles 35 onto the polishing cloth 10 are scattered from the polishing table 11 under centrifugal forces due to rotation of the polishing table 11, and are collected by the tub 17*a* in the frame 17. After the dressing process, the dresser 33 is returned to a standby position by the swing arm 31, and cleaned by a dresser cleaning unit 18 (see FIG. 2) disposed at the standby position.

In this embodiment, nitrogen gas is supplied from the gas source 40 to the ejection nozzles 35, and pure water is supplied as the cleaning liquid from the fluid source 50 to the ejection nozzles 35. However, only a liquid (cleaning liquid) may be supplied from the fluid source 50 to the ejection nozzles 35 without a gas being supplied from the gas source 40. In this case, the regulator 52 in the liquid passage 51 may be controlled to supply liquid (pure water) at a high pressure to the ejection nozzles 35 for removing polishing liquid and ground-off particles of semiconductor material from recesses in the polishing cloth 10.

Figure 8:
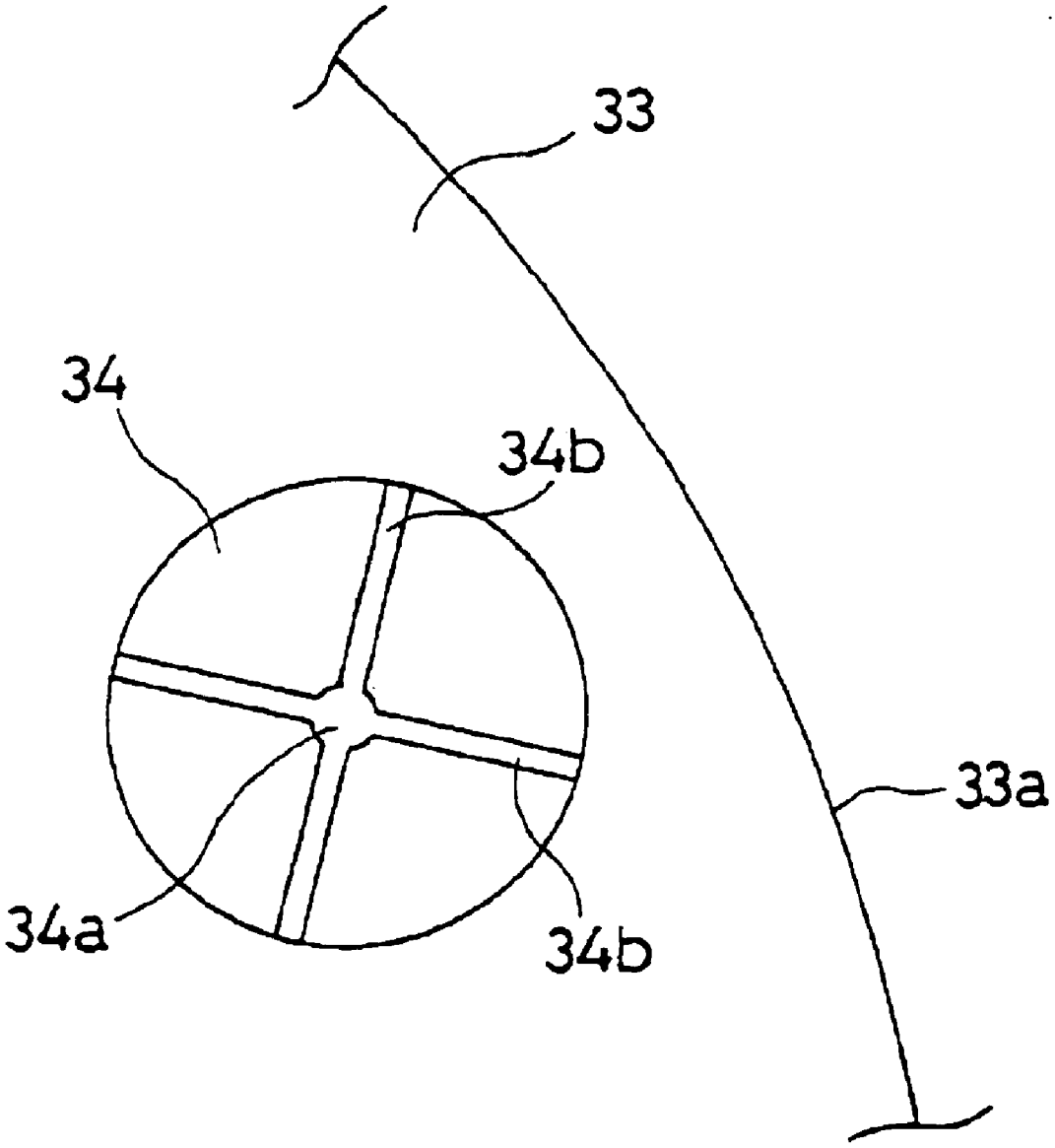
FIG. 8 is an enlarged view showing a dressing element according to another embodiment of the present invention.

The ejection nozzles 35 in the lower surface of the dresser 33 are not limited to the illustrated number and layout. The fluid flow hole 34*a* and the fluid ejection slots 34*b* which are defined in the dressing elements 34 are not limited to the illustrated positions and shapes. For example, as shown in FIG. 8, the dressing element 34 may have a fluid flow hole 34*a* defined at a central portion thereof and fluid ejection slots 34*b* defined therein at 90° intervals and extended radially outwardly from the fluid flow hole 34*a*. Further, in this embodiment, the dressing element 34 of the dresser 33 comprises a diamond pellet. However, each of the dressing elements 34 may comprise a brush.

Although certain preferred embodiments of the present invention have been shown and described in detail, it should be understood that various changes and modifications may be made therein without departing from the scope of the appended claims.

What is claimed is:

1. A polishing apparatus comprising:

a polishing table having a polishing surface thereon;

a top ring for pressing a workpiece to be polished against said polishing surface; and a dresser for dressing said polishing surface on the polishing table, said dresser including (i) a shaft to rotate said dresser about an axis passing through said dresser, (ii) a dressing element provided on a surface of said dresser for dressing said polishing surface by sliding contact with said polishing surface, and (iii) an ejection nozzle provided on the surface of said dresser for ejecting a fluid toward said polishing surface, said ejection nozzle being directed toward an outer circumferential edge of said dresser so as to eject the fluid toward the outer circumferential edge of said dresser, wherein said dressing element has a fluid flow hole defined therethrough for flowing the fluid to a lower surface of said dressing element, and a fluid ejection slot defined in the lower surface of said dressing element, and wherein said fluid ejection slot is extended from said fluid flow hole to an outer circumferential edge of said dressing element.

2. The polishing apparatus according to claim 1, wherein said dressing element is annularly disposed on a lower surface of said dresser, and said ejection nozzle is disposed inside of said dressing element.

3. The polishing apparatus according to claim 1, wherein said fluid ejection slot is extended toward the outer circumferential edge of said dresser.

4. The polishing apparatus according to claim 1, wherein the fluid comprises a mixture of a fluid supplied from a fluid source and a gas supplied from a gas source.

5. The polishing apparatus according to claim 4, wherein said dressing element is annularly disposed on a lower surface of said dresser, and said ejection nozzle is disposed inside of said dressing element.

6. The polishing apparatus according to claim 4, wherein said fluid rejection slot is extended toward the outer circumferential edge of said dresser.

7. The polishing apparatus according to claim 4, wherein said dresser further includes a rotary joint provided in a passage for supplying the mixture of the fluid and the gas to said ejection nozzle.

8. The polishing apparatus according to claim 1, wherein said dresser further includes a rotary joint provided in a passage for supplying the fluid to said ejection nozzle.

9. A dresser for dressing a polishing surface on a polishing table, said dresser comprising:

a shaft to rotate said dresser about an axis passing through said dresser;

a dressing element provided on a surface of said dresser for dressing said polishing surface by sliding contact with the polishing surface; and an ejection nozzle provided on the surface of said dresser for ejecting a fluid toward the polishing surface, said ejection nozzle being directed toward an outer circumferential edge of said dresser so as to eject the fluid toward the outer circumferential edge of said dresser, wherein said dressing element has a fluid flow hole defined therethrough for flowing the fluid to a lower surface of said dressing element, and a fluid ejection slot defined in the lower surface of said dressing element, and wherein said fluid ejection slot is extended from said fluid flow hole to an outer circumferential edge of said dressing element.

10. The dresser according to claim 9, wherein said dressing element is annularly disposed on a lower surface of said dresser, and said ejection nozzle is disposed inside of said dressing element.

11. The dresser according to claim 9, wherein said fluid ejection slot is extended toward the outer circumferential edge of said dresser.

12. The dresser according to claim 9, wherein the fluid comprises a mixture of a fluid supplied from a fluid source and a gas supplied from a gas source.

13. The dresser according to claim 12, wherein said dressing element is annularly disposed on a lower surface of said dresser, and said ejection nozzle is disposed inside of said dressing element.

14. The dresser according to claim 12, wherein said fluid ejection slot is extended toward the outer circumferential edge of said dresser.

15. The dresser according to claim 12, further comprising a rotary joint provided in a passage for supplying the mixture of the fluid and the gas to said ejection nozzle.

16. The dresser according to claim 9, further comprising a rotary joint provided in a passage for supplying the fluid to said ejection nozzle.

* * * * *